US005541043A

United States Patent [19]

Inoie et al.

[11] Patent Number: 5,541,043

[45] Date of Patent: Jul. 30, 1996

[54] SILVER HALIDE COLOR PHOTOGRAPHIC LIGHT-SENSITIVE MATERIAL

[75] Inventors: Hiroshi Inoie; Masao Iwamuro, both of Hino, Japan

[73] Assignee: Konica Corporation, Japan

[21] Appl. No.: 350,009

[22] Filed: Jan. 23, 1995

[30] Foreign Application Priority Data

Jan. 28, 1994 [JP] Japan ..... 6-008691

[51] Int. Cl.[6] ..... G03C 1/46

[52] U.S. Cl. ..... 430/503; 430/567; 430/568; 430/569; 430/570; 430/578; 430/580; 430/581; 430/591

[58] Field of Search ..... 430/503, 567, 430/568, 569, 570, 578, 580, 581, 591

[56] References Cited

U.S. PATENT DOCUMENTS

| | | | |
|---|---|---|---|
| 4,474,872 | 10/1984 | Onishi et al. | 430/570 |
| 4,596,764 | 6/1986 | Ishimaru | 430/568 |
| 5,009,988 | 4/1991 | Yagi et al. | 430/567 |

FOREIGN PATENT DOCUMENTS 1570362 7/1980 United Kingdom .

*Primary Examiner*—Geraldine Letscher
*Attorney, Agent, or Firm*—Jordan B. Bierman; Bierman and Muserlian

[57] ABSTRACT

A silver halide color photographic material is disclosed, comrising a support provided thereon light-sensitive silver halide emulsion layers including a blue-sensitive silver halide emulsion layer, a green-sensitive silver halide emulsion layer and a red-sensitive silver halide emulsion layer, and a non-image forming layer which is located farther from the support than the light-sensitive silver halide emulsion layers and adjacent to one of the light-sensitive silver halide emulsion layers, wherein a silver halide emulsion contained in the layer adjacent to the non-image forming layer is spectrally sensitized by adding a water-insoluble sensitizing dye in the form of solid particles dispersed in an aqueous medium; and the non-image forming layer contains a substantially light-insensitive silver halide fine grain emulsion having an average grain size of not more than 0.05 μm and an average iodide content of 0.5 to 3.0 mol %.

7 Claims, No Drawings

SILVER HALIDE COLOR PHOTOGRAPHIC LIGHT-SENSITIVE MATERIAL

FIELD OF THE INVENTION

This invention relates to a silver halide color photographic light-sensitive material and, particularly, to a silver halide color photographic light-sensitive material excellent in aging preservability and, particularly, in preservability high humidity.

DESCRIPTION OF THE PRIOR ART

In recent years, a measure to counter a resource saving, an energy saving and an environmental problem have been required for a silver halide color photographic light-sensitive material (hereinafter sometimes referred to as a color light-sensitive material or color photographic material). Particularly about an environmental problem, a measure to counter a waste liquor drained from a development process has been urgently required and, accordingly, the techniques for reducing replenishment and a processing without effluent have been remarkably developed.

In a color light-sensitive material, on the other hand, it has been known in the field of the art that finely grained iodide containing silver halide is contained in a protective layer so as to control a photographic performance variation that may be produced when the compositions of a developer is varied. This technique has been one of the techniques necessary for reduction of the replenishment.

From the viewpoint of a resource saving, that is, from the viewpoint of the effective utilization of silver resources which are the raw materials of silver halide grains applicable to a light-sensitive material, a light-sensitive material has been so demanded as to save an amount of silver coated as much as possible. The silver saving issues have been subject not only to a light-sensitive silver halide emulsion, but also to a non-light-sensitive silver halide emulsion or colloidal silver.

On a non-light-sensitive finely grained silver halide, there has so far been such an attempt that an amount of silver coated has been saved by making the grain-size thereof smaller so as to control a photographic performance variation produced when the composition of a development processing solution is varied. However, there has still been such a problem remaining unsolved that the preservability of an adjacent light-sensitive layer has been deteriorated and the performance thereof have seriously been deteriorated particularly under a high humidity condition.

It is, therefore, an object of the invention to provide a silver halide color photographic light-sensitive material excellent in processing stability and preservation stability.

SUMMARY OF THE INVENTION

The objects of the invention can be achieved with a silver halide color photographic light-sensitive material having the following constitution.

(1). In a color photographic light-sensitive material comprising a support bearing thereon at least one each of blue-sensitive, green-sensitive and red-sensitive silver halide emulsion layers and a non-image forming layer positioned farther from the support than a color-sensitive silver halide emulsion layer positioned farthest from the support, which is adjacent to the non-image forming layer; the silver halide color photographic light-sensitive material characterized in that a silver halide emulsion contained in the color-sensitive layer adjacent to the non-image forming layer is spectrally sensitized by adding a substantially water-insoluble sensitizing dye in the form of solid particle dispersion, and that the non-image forming layer contains a non-light-sensitive, finely grained silver halide emulsion having an average grain-size of not larger than 0.05 μm and a silver iodide content of 0.5 to 3.0 mol %.

(2). The silver halide color photographic light-sensitive material as described in paragraph (1), wherein the solubility (at 27° C.) of the water-insoluble sensitizing dye in water is within the range of $2\times10^{-4}$ to $4\times10^{-2}$ mols/liter.

(3). The silver halide color photographic light-sensitive material as described in paragraph (1), wherein the sensitizing dye is dispersed in the form of solid particles by a high-speed stirrer under the conditions of a revolution speed within the range of 1000 to 6000 rpm, a dispersion temperature within the range of 15° to 50° C. and a weight ratio of the sensitizing dye to water within the range of 0.2 to 5.0% each in deionized water.

(4). The silver halide color photographic light-sensitive material as described in paragraph (1), wherein the non-light-sensitive, finely grained silver halide emulsion is monodispersed to have a grain-size distribution width of not more than 20%.

(5). The silver halide color photographic light-sensitive material as described in paragraph (1), wherein the non-light-sensitive, finely grained silver halide emulsion is desalted in the presence of amino group-modified gelatin and at a pH of not higher than 5.5, after the grain is formed, and the emulsion is dispersed in low calcium-containing gelatin.

(6). In a color photographic light-sensitive material comprising a support bearing thereon at least one each of blue-sensitive, green-sensitive and red-sensitive silver halide emulsion layers and a non-image forming layer positioned farther to the support than a color-sensitive silver halide emulsion layer positioned farthest from the support, which is adjacent to the non-image forming layer; the silver halide color photographic light-sensitive material characterized in that a silver halide emulsion contained in the color-sensitive layer adjacent to the non-image forming layer is spectrally sensitized by adding a substantially sensitizing dye having a solubility to water (at 27° C.) within the range of $2\times10^{-4}$ to $4\times10^{-2}$ mols/liter, in the form of solid particle dispersed under the conditions of a revolution speed within the range of 1000 to 6000 rpm through a high-speed stirrer, a dispersion temperature within the range of 15° to 50° C. and a weight ratio of the sensitizing dye to water within the range of 0.2 to 5.0 % each in deionized water; and that the non-image forming layer contains a non-light-sensitive, monodispersed finely grained silver halide emulsion having an average grain-size of not larger than 0.05 μm, a silver iodide content within the range of 0.5 to 3.0 mol % and a grain-size distribution width of not wider than 20% and, after forming the grains, the emulsion is desalted in the presence of amino group-modified gelatin at a pH of not higher than 5.5 and is then dispersed in low calcium-containing gelatin.

DETAILED DESCRIPTION OF THE INVENTION

In the process of preparing a non-light-sensitive, finely grained silver halide emulsion of the invention, gelatin is preferably used as a hydrophilic colloid, and a physically ripened silver halide emulsion is preferable to be desalted by a coagulation-precipitation process or the like.

In an embodiment of the invention, a coagulant relating to a coagulation-precipitation process may be any one commonly known. For example, the compounds applicable thereto include, those given in Japanese Patent Examined Publication No. 35-16086/1960, Japanese Patent Publication Open to Public Inspection (hereinafter referred to as JP POI Publication) No. 62-32445/1987, Japanese Patent Application No. 62-313205/1987, and so forth.

Amino group-modified gelatin preferably applicable to form or desalt a silver halide fine grain emulsion include amino group-modified gelatin in which not less than 50% of the amino groups contained in the gelatin molecule are substituted. The examples of the substitution of the amino groups of gelatin are given in U.S. Pat. Nos. 2,691,582, 2,614,928 and 2,525,753.

The useful substituents applicable to the amino group modification include, for example, (1) An acyl group such as an alkyl acyl, aryl acyl, acetyl, or a substituted or unsubstituted benzoyl;

(2) A carbamoyl group such as an alkyl carbamoyl, or aryl carbamoyl;

(3) A sulfonyl group such as an alkyl sulfonyl, or aryl sulfonyl;

(4) A thiocarbamoyl group such as an alkylthiocarbamoyl, or arylthiocarbamoyl;

(5) A straight-chained or branched alkyl group having 1 to 18 carbon atoms; and (6) An aryl group such as a substituted or unsubstituted phenyl or naphthyl, and a heterocyclic group such as pyridyl and furyl.

Among them, the preferable amino group-modified gelatin include an acyl group, $—COR^1$ or carbamoyl group, $—CON(R^1)(R^2)$, wherein $R^1$ represents a substituted or unsubstituted aliphatic group (such as an alkyl group having 1 to 18 carbon atoms and an alkenyl group), an aryl group or an aralkyl group (such as a phenethyl group), and $R^2$ represents a hydrogen atom, an aliphatic group, an aryl group or an aralkyl group. Preferably, $R^1$ represents an aryl group and $R^2$ represents a hydrogen atom.

As for examples thereof, G-1 through G-12 given in JP OPI Publication No. 3-209236/1991, pp. 8–9 are particularly preferable.

There is no special limitation to the amounts of amino-modified gelatin to be used in a desalting treatment. However, it is suitable to use 5 to 100 g and, preferably, 10 to 80 g per mol of silver.

It is also allowed that such a heavy metal ion as magnesium ion, cadmium ion, lead ion or zirconium ion may be added in combination with amino group-modified gelatin.

Amino modified gelatin relating to the invention is used when carrying out a desalting treatment. It is, however, preferable to make such an amino denatured gelatin present when forming a fine grain and then to make it present as it is when carrying out a desalting treatment. As for another embodiment, it may also be added in the course of forming the fine grains or after forming the fine grains.

In an embodiment of the invention, a silver halide emulsion is coagulated by controlling the pH thereof after forming the fine grains. A pH for causing a coagulation is to be within the range of 2.0 to 5.5 and, preferably, 3.0 to 5.0. When the pH exceeds 5.5, the desalting efficiency is seriously deteriorated. There is no special limitation to an acid applicable to control the pH values. It is preferable to make use of such an organic acid as acetic acid, citric acid, salicylic acid and so forth, and such an inorganic acid as hydrochloric acid, nitric acid, sulfuric acid, phosphoric acid and so forth.

A desalting treatment may be carried out once or some times repeatedly. When repeating the treatments, it is allowed to make use of a coagulant.

After completing a desalting treatment, the pH is adjusted to be within the range of 5.5 to 6.5, if required. There is no limitation to alkali applicable to control the pH values. It is preferable to make use of sodium hydroxide, potassium hydroxide, sodium carbonate, potassium carbonate or the like.

In an embodiment of the invention, a low calcium-containing gelatin applicable after completing a desalting treatment is used for the purpose of dispersing silver halide grains.

A low calcium gelatin of the invention may be prepared by subjecting an ordinary gelatin ion-exchange treatment.

As for the low calcium gelatin, it is generally preferable to make use of those prepared by ion-exchange treating the first extracted gelatin among those extracted several times after lime-treating a cattle bone as a raw material of the gelatin.

A calcium content of gelatin is preferably not more than 1000 ppm and, particularly, not more than 500 ppm. As for such a low calcium gelatin, it is allowed to make use of a lime-treated ossein gelatin alone or to make use in combination with other gelatin than lime-treated ossein gelatin as far as it may be used. It is preferable that lime-treated ossein gelatin is contained in an amount of not less than 60%.

Low calcium gelatin may be used in an amount within the range of, suitably, 5 to 100 g and, preferably, 20 to 80 g per mol of silver.

After completing a desalting treatment and then adding low calcium gelatin, it is also allowed to make a redispersion treatment for dispersing a finely grained silver halide emulsion. At that time, the temperature is within the range of, suitably, 30° to 75° C. and, preferably, 40° to 65° C. There is no limitation to the time, however, it is preferable to take a time within the range of 30 to 100 minutes.

In the embodiments of the invention, silver halide fine grains may be composed of silver iodochloride, silver iodobromide or silver iodobromo-chloride. Among them, is preferred silver iodobromide containing silver iodide of 0.5 to 3.0 mol % and, preferably, 1.5 to 2.5 mol %. When the silver iodide content is less than 0.5 mol % or exceeds 3 mol %, the sensitivity of the subject light-sensitive material is seriously varied when it is preserved.

The finely grained silver halide emulsion as mentioned above is preferable to be of the monodisperse type. The average grain-size thereof is to be not larger than 0.05 μm and, preferably within the range of 0.02 to 0.04 μm. When the average grain-size thereof exceeds 0.05 μm, the effect of processing stability becomes little.

The coating amount of a finely grained silver halide emulsion of the invention is within the range of, preferably, 0.005 to 1 $g/m^2$ and, particularly, 0.01 to 0.4 $g/m^2$.

In the invention, a monodisperses finely grained silver halide emulsion means that in which not less than 70%, preferably not less than 80% and more preferably not less than 90% by weight of the whole silver halide is accounted for by silver halide grains having grain-sizes within the range of an average grain-size (dm)±20%.

The term, average grain-size dm, herein stated is defined as grain-size di obtained when a product $ni \times di^3$ is maximized in which ni represents the frequency of grains having a grain-size di. The term, a grain-size, herein stated means a diameter of a grain obtained when a projected grain image is converted into a circle having the same area.

A grain-size can be obtained in such a manner, for example, that grains were macrophotographed at 50,000 to 200,000 times through an electron microscope and the diameter of the printed grain image or the area of the projected grain image is practically measured, (provided that the numbers of the grains subject to the measurement are to be not less than 1,000 grains at random.)

A preferable monodisperse type emulsion of the invention has a grain-size distribution width of not wider than 20% and, preferably, not wider than 15%. The term, a grain-size distribution width, is defined by the following formula;

(Standard grain-size deviation/An average grain-size)×100=Grain-size distribution width (%)

In the invention, the grain-size measurement method is to be made in accordance with the above-mentioned procedures, and an average grain-size is to be expressed in terms of a number-average.

There is no special limitation to the structures or types of a finely grained silver halide emulsion relating to the invention. The emulsion grains may be of such as a twinned crystal grain having twinned crystal faces, a cubic, a tetradecahedral, a regular octahedral, or a sphere formed grains. Besides, the emulsion grains may also be of the core-shell type grain having the different silver halide compositions between the core of the grain and the shell layer thereof.

There is no special limitation to the processes for preparing a finely grained silver halide relating to the invention. For example, the above-mentioned silver halide can be prepared by applying the following processes, namely, a neutral process, an acidic process, an ammoniacal process, a normal precipitation process, a reverse precipitation process, a double-jet process, a controlled-double-jet process, a conversion process, a core/shell process and so forth, of which are detailed in such a literature as T. H. James, The Theory of The Photographic Process, the 4th Ed., MacMillan Book Company, (1977), pp. 38–104.

When preparing a finely grained silver halide emulsion relating to the invention, it is preferable that a grain formation and a desalting treatment are carried out in the presence of a polyoxyalkylene compound.

Silver halide grains applicable to the invention are grown up in an acidic process, a neutral process or an ammoniacal process each having been well-known in the art, and then an emulsion is desalted. The above-mentioned processes are detailed in such a published book as the foregoing literature.

In the growth of silver halide grains (including the case of preparing a seed grain), the following preparation process is applied. The pH, pAg, and temperature inside a reaction chamber are controlled and, for example, silver ion and halide ion are then added to be mixed up one after another or at the same time so as to meet the growing rate of AgX, as described in JP OPI Publication No. 54-48521/1979.

A non-image-forming layer relating to the invention means a non-photosensitive (light insensitive) layer. The non-image-forming layer contains a silver halide fine grain emulsion having a sensitivity not less than 1/10 and, preferably, not higher than 1/20 to a photosensitive silver halide grain.

The non-image forming layer may be comprised of either one or two layers. It is preferable to comprise two layers. It is also allowed that a non-photosensitive, finely grained, silver halide emulsion relating to the invention may be contained in either two layers or one of the two layers. It is, however, preferable to contain the emulsion in one of the two layers.

A substantially water-insoluble spectrally sensitizing dye in the form of solid perticle dispersion herein means a state where the following spectrally sensitizing dye is added in an amount exceeding the solubility thereof so as to be mechanically dispersed in the form of solid fine particles having a particles-size of not larger than 1 μm. The spectrally sensitizing dye is to have a solubility of $1\times10^{-4}$ to $4\times10^{-2}$ mols/liter and, preferably, $2\times10^{-4}$ to $4\times10^{-2}$ mols/liter at 27° C. in an aqueous medium where neither organic solvent nor surfactant is not present.

In the invention, it is preferable that a spectrally sensitized silver halide emulsion is contained in a layer adjacent to a non-image forming layer containing the above-mentioned finely grained silver halide emulsion, is contained a silver halide emulsion spectral-sensitized by adding the substantially water-insoluble sensitizing dye in the form of solid particles without making use of any organic solvent. It is also allowed that a spectrally sensitized silver halide emulsion may be contained in the other light-sensitive silver halide emulsion layer(s).

In the invention, any organic solvent such as those having so far been used is not contained substantially. As mentioned above, any surfactant having so far been used as a dispersant for a sensitizing dye is not also contained substantially.

In the invention, the expression, an aqueous medium substantially free from an organic solvent and a surfactant, herein means water containing impurities in such an amount that a silver halide photographic emulsion cannot be spoiled and, it means, preferably, ion-exchanged water.

The phrase, substantially free from an organic solvent means that the proportion of the organic solvent in water is 10% (wt.) or less, preferably 5% or less, and more preferably 3% or less. The organic solvent is referred to a carbon atom-containing solvent which is liquid at room temperature. Heretofore, as a solvent for a sensitizing dye, water-miscible organic solvents including alcohols, ketones, nitriles, and alkoxy alcohols have been used. Practically, methanol, ethanol, propyl alcohol, i-propyl alcohol, ethylene glycol, propylene glycol, 1,3-propane-diol, acetone, acetonitrile, 2-methoxyethanol and 2-ethoxyethanol are cited.

As to a surfactant, the proportion thereof in water is 0.01% (wt.) or less, preferably 0.001% or less. The surfactant includes an anionic, cationic, amphoteric and nonionic surfactant.

In the invention, the solubility (at 27° C.) of a spectrally sensitizing dye to water is within the range of $2\times10^{-4}$ to $4\times10^{-2}$ mols/liter and, preferably, $1\times10^{-3}$ to $4\times10^{-2}$ mols/liter. In other words, when the solubility is lower than the above-specified range, it was found that the resulting dispersion is precipitated after being dispersed, because the dispersed particles become remarkably larger and uneven, and that the adsorption of a dye to silver halide is hindered when the dispersion is added to a silver halide emulsion.

When a solubility is higher than the above-mentioned range, it was found that the viscosity of a dispersed matter is increased more than needed, that a dispersion is hindered by catching bubbles in, and that no dispersion can be performed in a more higher solubility.

In the invention, the term, a spectrally sensitizing dye, herein means a dye capable of producing an electron transfer to silver halide when it is adsorbed to the silver halide and is then photoexcited. However, such a dye as mentioned above does not include any organic dyestaff.

The spectrally sensitizing dyes of the invention may be any one, provided that the solubility thereof in water is within the range of $2\times10^{-4}$ to $4\times10^{-2}$ mols/liter. A cyanine dye is preferred and a cyanine dye having a hydrophilic group (such as a sulfo group and a carboxyl group) is more preferred.

The cyanine dyes are represented by the following formula.

Formula [S-I]

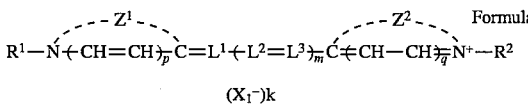

wherein $Z^1$ and $Z^2$ respectively represent a group of non-metallic atoms necessary for forming a 5-membered or 6-membered heterocyclic ring, provided that they may be the same or different; $R^1$ and $R^2$, which may be the same or different, independently represent an alkyl group or a substituted alkyl group; $L^1$, $L^2$ and $L^3$ independently represent a methine group or a substituted methine group; p and q independently represent 0 or 1; m represents 0 or 1; $X_1-$ represents an anion and k represents 0 or 1.

Examples of the dyes and solubilities thereof in water will be give below; provided, however, that the invention shall not be limited thereto,

| | | Solubility in water in terms of mol/liter |
|---|---|---|
| S-1 | 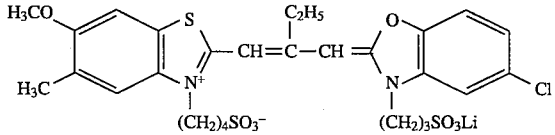 | $13.1\times10^{-3}$ |
| S-2 | 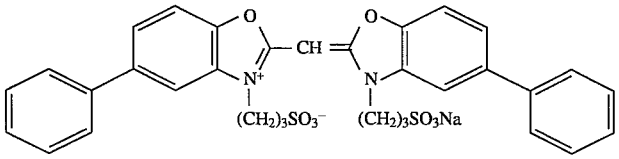 | $11.0\times10^{-3}$ |
| S-3 | 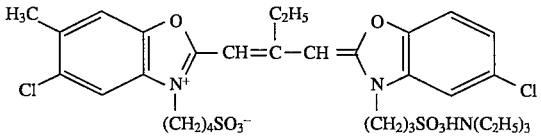 | $8.21\times10^{-3}$ |
| S-4 | 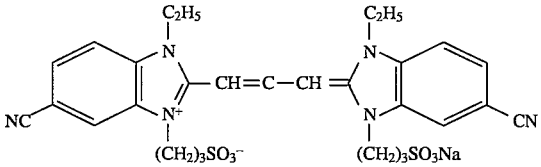 | $5.75\times10^{-3}$ |
| S-5 | 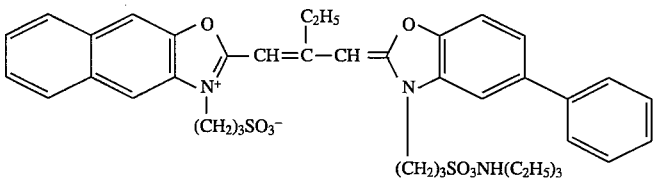 | $3.69\times10^{-3}$ |
| S-6 | 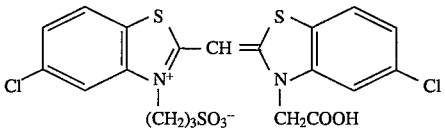 | $1.63\times10^{-3}$ |
| S-7 | 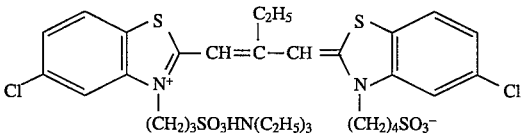 | $1.42\times10^{-3}$ |

-continued

| | | Solubility in water in terms of mol/liter |
|---|---|---|
| S-8 | 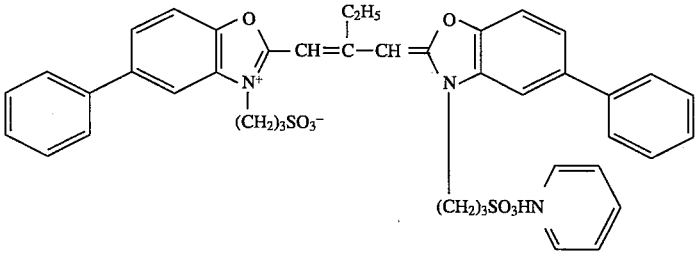 | $0.89 \times 10^{-3}$ |
| S-9 | 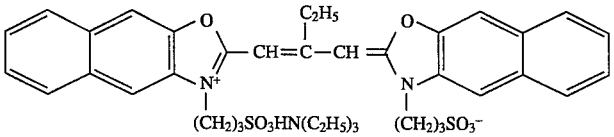 | $0.37 \times 10^{-3}$ |
| S-10 | 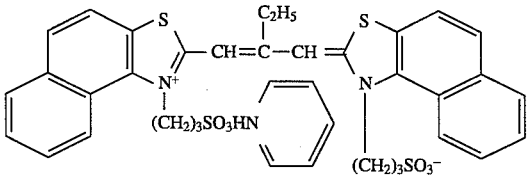 | $0.30 \times 10^{-3}$ |
| S-11 | 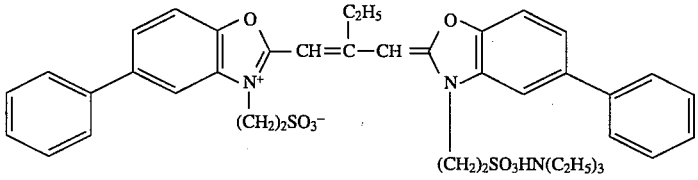 | $1.38 \times 10^{-3}$ |
| S-12 | 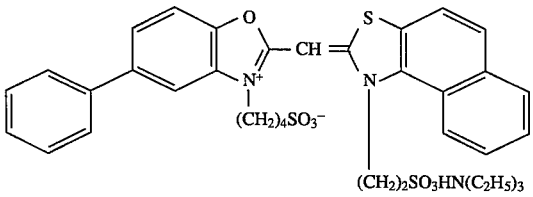 | $3.13 \times 10^{-3}$ |
| S-13 | 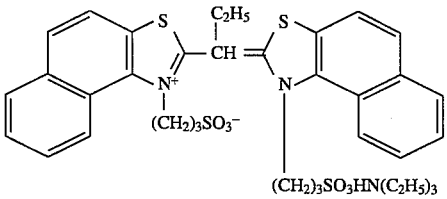 | $2.23 \times 10^{-3}$ |

In the invention, for mechanically pulverizing and dispersing a spectrally sensitizing dye in an aqueous medium, a variety of dispersing machines may effectively be used. A high-speed stirrer, a ball-mill, a sand mill, a colloid mill, an attriter, a supersonic disperser and so forth may be used. Among them, a high-speed stirrer is preferred for the invention.

It is also allowed that the high-speed stirring type dispersing machine has a dissolver equipped with plural impellers on the vertical shaft of the dissolver, or has a multishaft dissolver equipped with plural vertical shafts. Besides the dissolver alone, a high-speed stirring type dispersing machine having anchor blades is more preferred.

As a concrete example of the operations, water is put in a temperature controllable tank and spectrally sensitizing dye powder in a specific amount is then put therein. The mixture thereof is stirred, pulverized and then dispersed by making use of a high-speed stirrer, for a given time while controlling the temperature. There is no limitation to a pH and a temperature when mechanically dispersing a spectrally sensitizing dye. However, there may come into such a problem that any desired photographic characteristics may not be obtained, because any desired grain-size may not be obtained even if the dispersion is carried out over a period of a long time at a low temperature and also because a recoagulation or decomposition may be produced at a high temperature, and that the pulverizing or dispersing efficiency of solid particles may be seriously deteriorated, because the viscosity of a solution may be lowered when raising a temperature. Therefore, it is more preferable that a dispersion temperature is to be within the range of 15° to 50° C. Further, it is also more preferable to disperse the sensitizing dye at the number of stirring revolutions is to be within the range of 1,000 to 6,000 rpm, because it is required to take a long time to obtain a desired grain-size at a low number of revolutions, and because the dispersing efficiency may be lowered by catching bubbles in at a high number of revolutions.

The expression, solid fine particles of a spectrally sensitizing dye dispersed in the method of the invention is not larger than 1 μm, herein means that the particle-size thereof is not larger than 1 μm in terms of the volume average of a corresponding sphere. The particle-sizes can be measured by common procedures.

The term, a dispersion matter, stated in this invention means a suspension of a spectrally sensitizing dye. It is preferable to use the spectrally sensitizing dyes contained in the suspension, which have a weight ratio within the range of 0.2 to 5.0%.

A dispersion of a spectrally sensitizing dye prepared in the invention may be added to a silver halide emulsion directly or upon diluting it suitably. Water is used for dilution.

In a light-sensitive material of the invention, a physically or chemically ripened and spectrally sensitized light-sensitive silver halide emulsion is commonly used. The additives applicable to such a process as mentioned above are described in Research Disclosure Nos. 17643, 18716 and 308119 (hereinafter abbreviated to as RD17643, RD18716 and RD308119, respectively.)

The descriptions thereof appear as follows.

| [Article] | [RD308119] | [RD17643] | [RD18716] |
|---|---|---|---|
| Chemical sensitizer | 996 III-A | 23 | 648 |
| Spectral sensitizer | 996 IV-A,B,C, D,H,I,J | 23–24 | 648–9 |
| Super sensitizer | 996 IV-A-E,J | 23–24 | 648–9 |
| Antifoggant | 998 VI | 24–25 | 649 |
| Stabilizer | 998 VI | 24–25 | 649 |

The well-known additives for photographic use applicable to the invention also appear in the above-given Research Disclosures.

The corresponding descriptions appear as follows.

| [Article] | [RD308119] | [RD17643] | [RD18716] |
|---|---|---|---|
| Color contamination inhibitor | 1002 VII-I | 25 | 650 |
| Dye image stabilizer | 1001 VII-J | 25 | |
| Whitening agent | 998 V | 24 | |
| UV absorbent | 1003 VIII-C, XIIIC | 25–26 | |
| Absorbing materials | 1003 VIII | 25–26 | |
| Scattering materials | 1003 VIII | | |
| Filter dye | 1003 VIII | 25–26 | |
| Binder | 1003 | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Surfactant.Coating aid | 1005 XI | 26–27 | 650 |
| Matting agent | 1007 XVI | | |
| Developing agent (contained in a light-sensitive material) | 1011 XXB | | |

A variety of couplers are applicable to the invention. The concrete examples thereof are given in the following RDs. The corresponding descriptions thereof are as follows.

| [Article] | [RD308119] | [RD17643] |
|---|---|---|
| Yellow coupler | 1001 VII-D | VII C-G |
| Magenta coupler | 1001 VII-D | VII C-G |
| Cyan coupler | 1001 VII-D | VII C-G |
| Colored coupler | 1002 VII-G | VII G |
| DIR coupler | 1001 VII-F | VII F |
| BAR coupler | 1002 VII-F | |
| Other useful residual group releasing coupler | 1001 VII-F | |

An additive applicable to the invention may be added by such a dispersion method as described in RD308119 XIV.

In the invention, can be used the supports described in the foregoing RD17643, p. 28, RD18716, pp. 647–8, and RD308119, XIX.

To a light-sensitive material of the invention, such an auxiliary layer as a filter layer and an intermediate layer each described in the foregoing RD308119 VII-K may be provided.

The suitable supports applicable to the invention are described in, for example, RD17643, p. 28 and RD18716, the right column of p. 647 to the left column of p. 648.

The supports commonly applicable thereto include, for example, a sheet of paper laminated with polyethylene or the like, a polyethylene terephthalate film, a sheet of baryta paper, a cellulose triacetate film and so forth. The thickness of a support applicable thereto is commonly within the range of 50 to 200 μm.

EXAMPLES

Now, some of the concrete examples of the invention will be detailed below. However, the embodiments of the invention shall not be limited thereto.

In the following examples,- the amount of each component contained in a light-sensitive material is expressed in terms of a g/m$^2$ unit, provided, however, that the is expressed in terms of an equivalent amount of silver amount of silver halide coated and the amounts of sensitizing dyes, in terms of mol per mol of the silver halides contained in the same layer.

Example 1

Multilayered color photographic light-sensitive material sample 101 was so prepared as to provide each of the layers having the following compositions on a subbed cellulose triacetate film support.

| Sample 101 | |
|---|---|
| Layer 1: An antihalation layer (HC) | |
| Black colloidal silver | 0.15 |
| UV absorbent (UV-1) | 0.30 |
| High boiling solvent (Oil-1) | 0.16 |
| Gelatin | 1.64 |
| Layer 2: An intermediate layer (IL) | 0.80 |
| Gelatin | |

Layer 3: A low-speed red-sensitive layer (LR)

| | |
|---|---|
| Silver iodobromide emulsion A | 0.44 |
| Silver iodobromide emulsion C | 0.11 |
| Sensitizing dye (SD-1) | $2.6 \times 10^{-5}$ |
| Sensitizing dye (SD-2) | $2.6 \times 10^{-5}$ |
| Sensitizing dye (SD-3) | $3.1 \times 10^{-4}$ |
| Sensitizing dye (SD-4) | $2.3 \times 10^{-5}$ |

-continued

| | |
|---|---|
| Sensitizing dye (SD-5) | $2.8 \times 10^{-4}$ |
| Cyan coupler (C-1) | 0.35 |
| Colored cyan coupler (CC-1) | 0.065 |
| Compound (GA-1) | $2.0 \times 10^{-3}$ |
| High boiling solvent (Oil-1) | 0.33 |
| Gelatin | 0.73 |

Layer 4: A medium-speed red-sensitive layer (MR)

| | |
|---|---|
| Silver iodobromide emulsion C | 0.39 |
| Sensitizing dye (SD-1) | $1.3 \times 10^{-4}$ |
| Sensitizing dye (SD-2) | $1.3 \times 10^{-4}$ |
| Sensitizing dye (SD-3) | $2.5 \times 10^{-4}$ |
| Sensitizing dye (SD-4) | $1.8 \times 10^{-5}$ |
| Cyan coupler (C-1) | 0.24 |
| Colored cyan coupler (CC-1) | 0.040 |
| DIR compound (D-1) | 0.025 |
| Compound (GA-1) | $1.0 \times 10^{-3}$ |
| High boiling solvent (Oil-1) | 0.30 |
| Gelatin | 0.59 |

Layer 5: A high-speed red-sensitive layer (HR)

| | |
|---|---|
| Silver iodobromide emulsion D | 0.91 |
| Sensitizing dye (SD-1) | $8.5 \times 10^{-5}$ |
| Sensitizing dye (SD-2) | $9.1 \times 10^{-5}$ |
| Sensitizing dye (SD-3) | $1.7 \times 10^{-4}$ |
| Sensitizing dye (SD-4) | $2.3 \times 10^{-5}$ |
| Sensitizing dye (SD-6) | $1.1 \times 10^{-5}$ |
| Cyan coupler (C-2) | 0.10 |
| Colored cyan coupler (CC-1) | 0.014 |
| DIR compound (D-1) | $7.5 \times 10^{-3}$ |
| Compound (GA-1) | $1.4 \times 10^{-3}$ |
| High boiling solvent (Oil-1) | 0.12 |
| Gelatin | 0.53 |

Layer 6: An intermediate layer (IL)

| | |
|---|---|
| Gelatin | 1.14 |

Layer 7: A low-speed green-sensitive layer (LG)

| | |
|---|---|
| Silver iodobromide emulsion B | 0.32 |
| Silver iodobromide emulsion C | 0.74 |
| Sensitizing dye (SD-7) | $5.5 \times 10^{-4}$ |
| Sensitizing dye (SD-1) | $5.2 \times 10^{-5}$ |
| Sensitizing dye (SD-12) | $4.8 \times 10^{-5}$ |
| Magenta coupler (M-1) | 0.15 |
| Magenta coupler (M-2) | 0.37 |
| Colored magenta coupler (CM-1) | 0.20 |
| DIR compound (D-2) | 0.020 |
| Compound (GA-1) | $4.0 \times 10^{-3}$ |
| High boiling solvent (Oil-2) | 0.65 |
| Gelatin | 1.65 |

Layer 8: A high-speed green-sensitive layer (HG)

| | |
|---|---|
| Silver iodobromide emulsion E | 0.79 |
| Sensitizing dye (SD-8) | $1.4 \times 10^{-4}$ |
| Sensitizing dye (SD-9) | $1.5 \times 10^{-4}$ |
| Sensitizing dye (SD-10) | $1.4 \times 10^{-4}$ |
| Sensitizing dye (SD-12) | $7.1 \times 10^{-5}$ |
| Magenta coupler (M-2) | 0.065 |
| Magenta coupler (M-3) | 0.025 |
| Colored cyan coupler (CM-2) | 0.025 |
| DIR compound (D-3) | $7.0 \times 10^{-4}$ |
| Compound (GA-1) | $1.8 \times 10^{-3}$ |
| High boiling solvent (Oil-2) | 0.15 |
| Gelatin | 1.46 |

Layer 9: A yellow filter layer (YC)

| | |
|---|---|
| Yellow colloidal silver | 0.10 |
| Compound (SC-1) | 0.14 |

-continued

| | |
|---|---|
| Compound (FS-1) | 0.20 |
| High boiling solvent (Oil-2) | 0.18 |
| Gelatin | 1.20 |

Layer 10: A low-speed blue-sensitive layer (LB)

| | |
|---|---|
| Silver iodobromide emulsion B | 0.27 |
| Silver iodobromide emulsion C | 0.32 |
| Sensitizing dye (SD-11) | $5.4 \times 10^{-4}$ |
| Sensitizing dye (SD-12) | $2.0 \times 10^{-4}$ |
| Sensitizing dye (SD-6) | $6.5 \times 10^{-5}$ |
| Yellow coupler (Y-1) | 0.62 |
| Yellow coupler (Y-2) | 0.31 |
| Compound (GA-1) | $4.5 \times 10^{-3}$ |
| High boiling solvent (Oil-2) | 0.20 |
| Gelatin | 1.27 |

Layer 11: A high-speed blue-sensitive layer (HB)

| | |
|---|---|
| Silver iodobromide emulsion E | 0.66 |
| Sensitizing dye (SD-11) | $2.8 \times 10^{-4}$ |
| Sensitizing dye (SD-12) | $1.1 \times 10^{-4}$ |
| Sensitizing dye (SD-6) | $1.1 \times 10^{-5}$ |
| Yellow coupler (Y-1) | 0.10 |
| Compound (GA-1) | $2.0 \times 10^{-3}$ |
| High boiling solvent (Oil-2) | 0.04 |
| Gelatin | 0.57 |

Layer 12: A protective layer-1 (Pro-1)

| | |
|---|---|
| Non-light-sensitive, finely grained, silver halide emulsion Xa (having an average grain-size of 0.04 μm and a silver iodide content of 4.0 mol %) | 0.30 |
| UV absorbent (UV-2) | 0.030 |
| UV absorbent (UV-3) | 0.015 |
| UV absorbent (UV-4) | 0.015 |
| UV absorbent (UV-5) | 0.015 |
| UV absorbent (UV-6) | 0.010 |
| Compound (FS-1) | 0.25 |
| High boiling solvent (Oil-1) | 0.07 |
| High boiling solvent (Oil-3) | 0.07 |
| Gelatin | 1.04 |

Layer 13: Protective layer-2 (Pro-2)

| | |
|---|---|
| Alkali-soluble matting agent (having an average particle-size of 2 μm) | 0.15 |
| Polymethyl methacrylate (having an average particle-size of 3 μm) | 0.04 |
| Lubricant (WAX-1) | 0.04 |
| Gelatin | 0.55 |

Besides the above-given composites, coating aid SU-1, dispersing aid SU-2, a thickening agent, layer hardeners H-1 and H-2, stabilizer ST-1, antifoggant AF-1, dyes AI-1 and AI-2, two kinds of AF-2 having the molecular weights of 10,000 and 20,000 respectively, and preservative DI-1 were added.

The following emulsions were used in the above-mentioned sample. The average grain-sizes thereof are indicated by the grain-sizes obtained by converting the grains into the diameters of the spheres having the same volumes as the grains, respectively. Each of the emulsions was subjected optimally to gold.sulfur sensitization.

| Emulsion | Average iodide content (mol %) | Average grain size (μm) | Crystal habit | Ratio of diameter/ thickness |
|---|---|---|---|---|
| Emulsion A | 2.0 | 0.27 | Tetradecahedral regular crystal | 1 |
| Emulsion B | 2.0 | 0.30 | Tetradecahedral regular crystal | 1 |
| Emulsion C | 8.0 | 0.38 | Twinned octahedral crystal | 1.5 |
| Emulsion D | 8.0 | 0.55 | Twinned octahedral crystal | 1.5 |
| Emulsion E | 8.0 | 0.65 | Twinned octahedral crystal | 1.5 |

The non-light-sensitive, finely grained, silver halide emulsion contained in Layer 12 was prepared in the following manner.

A finely grained, monodispersed silver iodobromide emulsion having a silver iodide content of 4 mol % and an average grain-size of 0.04 μm was prepared by adding 40 g of amino group modified gelatin (i.e., phenyl carbamoyl gelatin manufactured by Rousselot Co.) and 30 mg of polyoxyalkylene compound (Pronone-102 manufactured by Nihon Yushi Co.), each per mol of silver, in a double-jet process while controlling the temperature and pAg at 40° C. and 9.0, respectively. (The grain-size distribution thereof was 14%.)

A finely grained silver halide emulsion Xa for comparative use was prepared in the following manner. Citric acid and magnesium sulfate were each added, at 40° C., to a completely mixed reaction liquid. The resulting mixture was stirred for 3 minutes and was then allowed to stand. Then, the unnecessary salts was removed therefrom in a decantation. After it was dispersed by adding ion-exchange water, magnesium sulfate was added thereto. After the resulting mixture was stirred for 3 minutes, it was allowed to stand and was then decanted again. After adjusting the pH to 6.0, gelatin having a calcium content of 230 ppm was added in an amount of 40 g per mol of silver. The resulting mixture was stirred for 30 minutes to be dispersed, while keeping the temperature at 50° C., so that the emulsion Xa was prepared.

Besides the above, emulsions Xb through Xi were each prepared by changing the specifications as follows.

| Finely grained AgX No. | Grain-size (μm) | AgI content (mol %) | Distribution range (%) | Gelatin when desalted | Ca content of redispersed gelatin (ppm) |
|---|---|---|---|---|---|
| Xa (Comp) | 0.04 | 4 | 14 | Modified gelatin | 230 |
| Xb (Inv) | 0.04 | 2 | 15 | Modified gelatin | 230 |
| Xc (Comp) | 0.07 | 4 | 14 | Modified gelatin | 230 |
| Xd (Comp) | 0.06 | 2 | 14 | Modified gelatin | 230 |
| Xe (Inv) | 0.04 | 3 | 15 | Modified gelatin | 230 |
| Xf (Comp) | 0.04 | 0 | 12 | Modified gelatin | 230 |
| Xg (Inv) | 0.03 | 2 | 13 | Modified gelatin | 230 |
| Xh (Inv) | 0.04 | 2 | 23 | Modified gelatin | 230 |
| Xi (Inv) | 0.04 | 2 | 15 | Unmodified gelatin | 1400 |

The additives used in the samples were given below.

Oil-1: Di(2-ethylhexyl)phthalate,

Oil-2: Tricresyl phosphate,

Oil-3: Dibutyl phthalate,

GA-1: Dodecyl gallate,

SC-1: 2-methyl-5-sec-octadecyl hydroquinone,

FS-1: 1-(3-sulfophenyl)-3-methyl-2-pyrazolidone-5-imide,

SU-1: Sodium dioctyl sulfosuccinate,

SU-2: Sodium tri-i-propyl naphthalene sulfonate,

H-1: Sodium 2,4-dichloro-6-hydroxy-s-triazine,

H-2: Di(vinyl sulfonyl methyl) ether,

ST-1: 4-hydroxy-6-methyl-1,3,3a,7-tetrazaindene,

AF-1: 1-phenyl-5-mercaptotetrazole,

AF-2: Poly-N-vinyl pyrrolidone

C-1

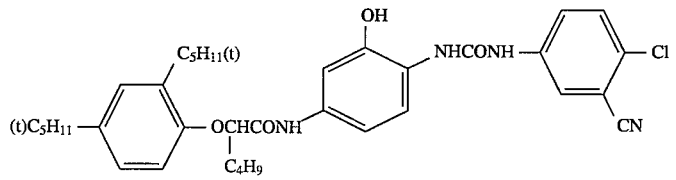

C-2

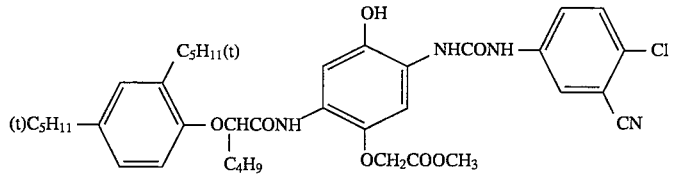

-continued
M-1
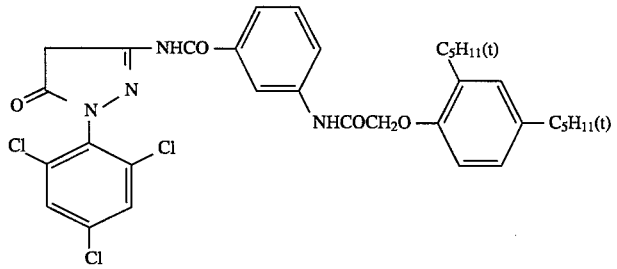
M-2
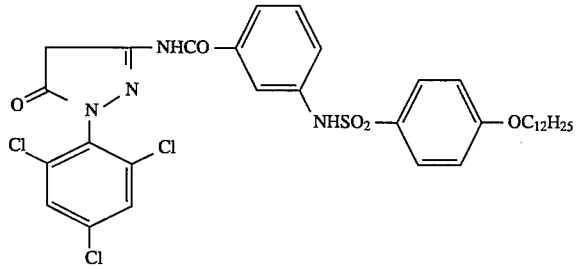
M-3
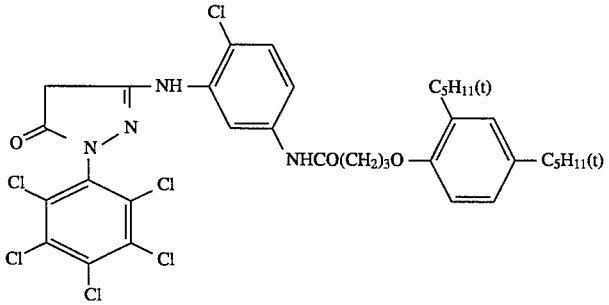
Y-1
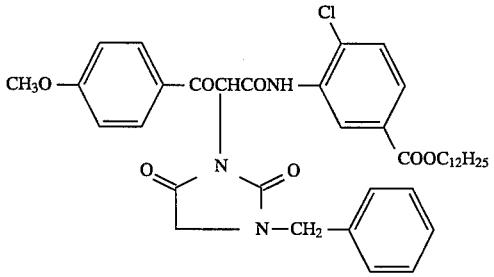
Y-2
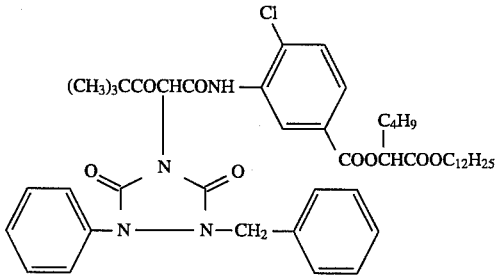

-continued
CC-1
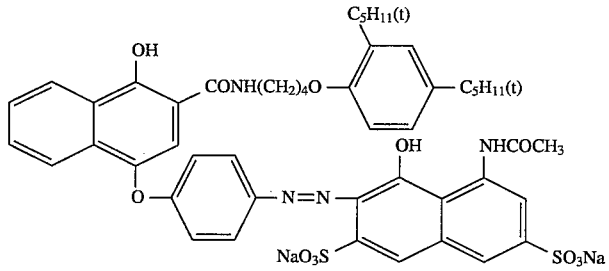
CM-1
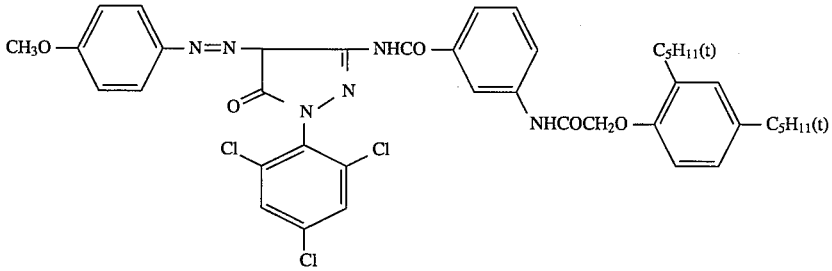
CM-2
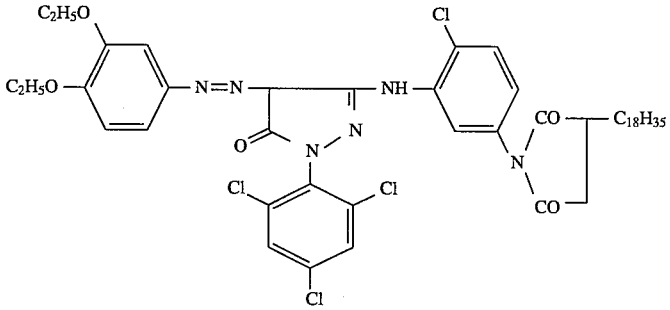
D-1
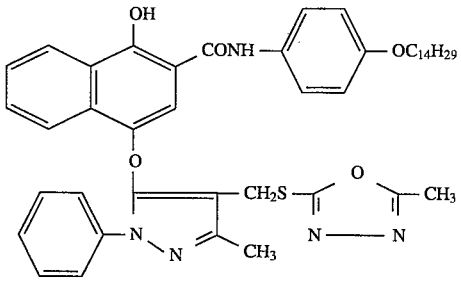
D-2
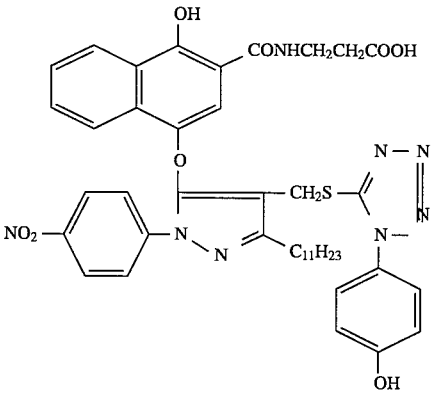

-continued
D-3
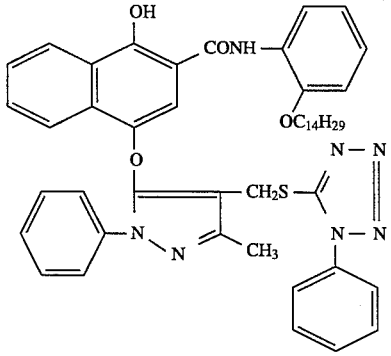
UV absorbent
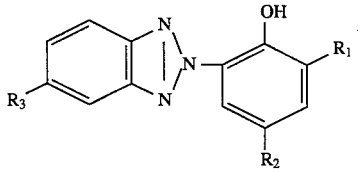
| | $R_1$ | $R_2$ | $R_3$ |
|---|---|---|---|
| UV-1 | $-C_{12}H_{25}$ | $-CH_3$ | $-H$ |
| UV-2 | $-H$ | $-C_4H_9(t)$ | $-H$ |
| UV-3 | $-C_4H_9(t)$ | $-C_4H_9(t)$ | $-H$ |
| UV-4 | $-C_4H_9(t)$ | $-CH_3$ | $-Cl$ |
| UV-5 | $-C_4H_9(t)$ | $-C_4H_9(t)$ | $-Cl$ |
UV-6
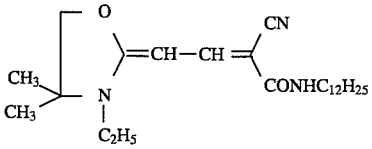
SD-1
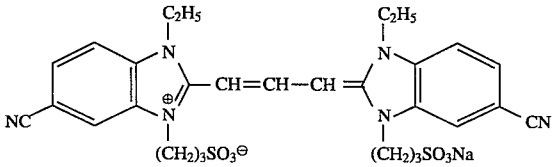
SD-2
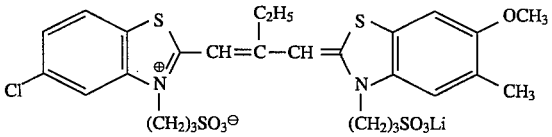
SD-3
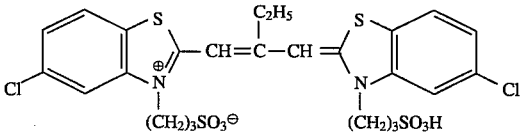
SD-4
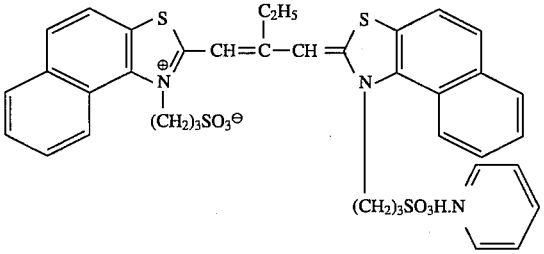

-continued
SD-5
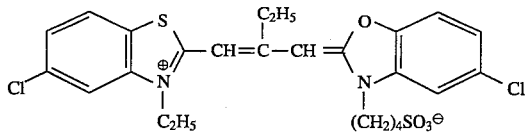
SD-6
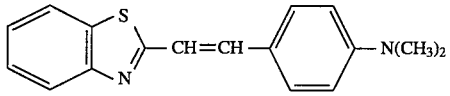
SD-7
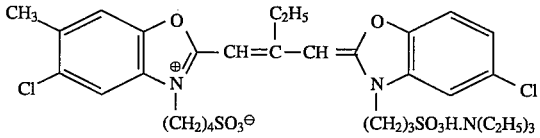
SD-8
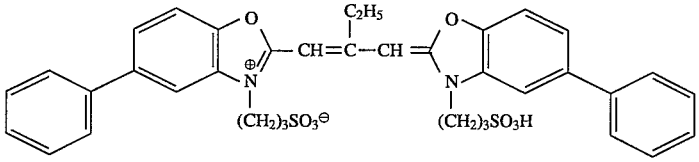
SD-9
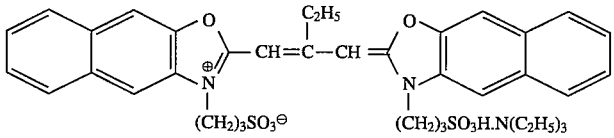
SD-10
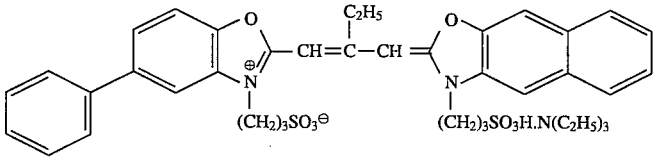
SD-11
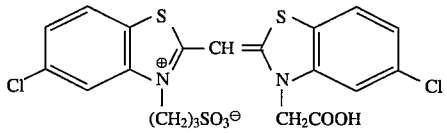
SD-12
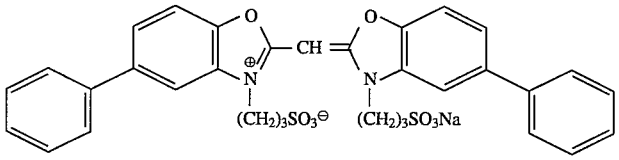
AI-1
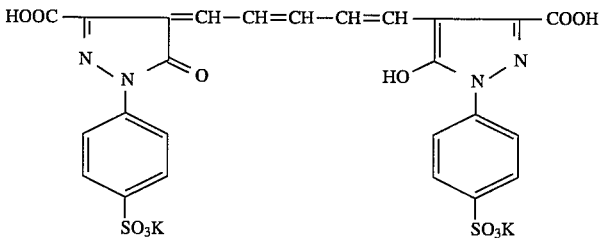

-continued

AI-2

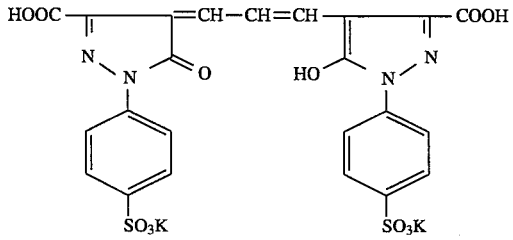

WAX-1

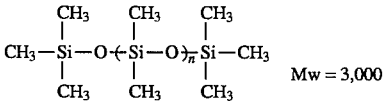

Mw = 3,000

DI-1

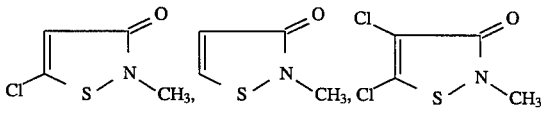

(Component A) (Component B) (Component C)
Component A:B:C = 50:46:4 (in mol ratio)

Samples 102 through 109 were each prepared in the same manner as in Sample 101, except that the method of adding the sensitizing dye to Layer 11 and the non-light-sensitive finely grained silver halide grains which are to be added to Layer 12 were varied as shown in Table 1.

Samples 101 through 109 were exposed to light through a wedge and were then developed in the following processing steps, (hereinafter referred to as Conditions A), and the same samples were allowed to stand for 7 or 14 days under the conditions of 40° C. and 80% RH and were then exposed and developed in the same manner as above, (hereinafter referred to as Conditions B and C, respectively).

With each of the samples subjected to Conditions A, B and C, the preservabilities thereof were evaluated in terms of sensitivity variations between conditions A and B or C (that was, relative sensitivity differences obtained from an exposure quantity capable of providing a density of fog +0.5: $\Delta S_7$ and $\Delta S_{14}$) of the blue-sensitive layers of each sample.

| Processing steps | | |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24–41° C. |
| 4. Fixing | 6 min. 30 sec. | 38.0 ± 3.0° C. |
| 5. Washing | 3 min. 15 sec. | 24–41° C. |
| 6. Stabilizing | 3 min. 15 sec. | 38.0 ± 3.0° C. |

The compositions of the processing solutions used in each of the processing steps were given below.

| <Color developer> | |
|---|---|
| 4-amino-3-methyl-N-ethyl-N-(β-hydroxyethyl) aniline sulfate | 4.75 g |
| Sodium sulfite anhydrous | 4.25 g |
| Hydroxylamine ½ sulfate | 2.00 g |
| Potassium carbonate anhydrous | 37.5 g |
| Sodium bromide | 1.30 g |
| Trisodium nitrilotriacetate (monohydrate) | 2.50 g |

-continued

| <Color developer> | |
|---|---|
| Potassium hydroxide | 1.00 g |
| Add water to make | 1 liter |
| Adjust pH to be | pH 10.1 |

| <Bleach> | |
|---|---|
| Iron ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | pH 6.0 |

| <Fixer> | |
|---|---|
| Ammonium thiosulfate | 175.0 g |
| Sodium sulfite anhydrous | 8.5 g |
| Sodium metasulfite | 2.3 g |
| Add water to make | 1 liter |
| Adjust pH with acetic acid to be | pH 6.0 |

| <Stabilizer> | |
|---|---|
| Formalin (in an aqueous 37% solution) | 1.5 cc |
| Konidux (manufactured by Konica Corp.) | 7.5 cc |
| Add water to make | 1 liter |

The results thereof will be shown in Table 1. In the table, addition methods of a sensitizing dye a and b were as follows.

a: A solution prepared by dissolving a sensitizing dye in methyl alcohol in a concentration of 0.5% was added.

b: A solution prepared by dispersing a sensitizing dye in water in the form of solid particles was added.

TABLE 1

| Sample No. | Method of adding sensitizing dye to Layer 11 | Non-light-sensitive AgX in Layer 12 No. | Grain-size (μm) | Iodide content (mol %) | Distribution width (%) | Sensitivity change of blue-sensitive layer $\Delta S_7$ | $\Delta S_{14}$ |
|---|---|---|---|---|---|---|---|
| 101 (Comparison) | a | Xa | 0.04 | 4 | 14 | −0.15 | −0.20 |
| 102 (Comparison) | b | Xa | 0.04 | 4 | 14 | −0.10 | −0.16 |
| 103 (Comparison) | a | Xb | 0.04 | 2 | 15 | −0.07 | −0.11 |
| 104 (Comparison) | b | Xc | 0.07 | 4 | 14 | −0.12 | −0.16 |
| 105 (Comparison) | b | Xd | 0.06 | 2 | 14 | −0.06 | −0.09 |
| 106 (Invention) | b | Xb | 0.04 | 2 | 15 | +0.01 | +0.03 |
| 107 (Invention) | b | Xe | 0.04 | 3 | 15 | −0.01 | −0.02 |
| 108 (Comparison) | b | Xf | 0.04 | 0 | 12 | +0.05 | +0.08 |
| 109 (Invention) | b | Xg | 0.03 | 2 | 13 | +0.02 | +0.03 |
| 110 (Invention) | b | Xh | 0.04 | 2 | 23 | −0.04 | −0.04 |
| 111 (Invention) | b | Xi | 0.04 | 2 | 14 | +0.04 | +0.05 |
| 112 (Comparison) | a | Xi | 0.04 | 2 | 14 | −0.13 | −0.17 |

As can be seen from the results shown in Table 1, the samples of the invention were excellent in preservability under a high humidity.

What is claimed is:

1. A silver halide color photographic light-sensitive material comprising:

(a) a support;

(b) a plurality of light-sensitive silver halide emulsion layers provided on the support, wherein the light-sensitive silver halide emulsion layers consist essentially of (1) a blue-sensitive silver halide emulsion layer, wherein a silver halide emulsion is spectrally sensitized by a process comprising (a) forming a dispersion of a water-insoluble sensitizing dye in the form of solid particles dispersed in an aqueous medium and (b) incorporating the dispersion in the silver halide emulsion;

(2) a green-sensitive silver halide emulsion layer;

(3) a red-sensitive silver halide emulsion layer; and (c) a non-image forming layer located at a position farther from the support than the light-sensitive silver halide emulsion layers and adjacent to the blue-sensitive silver halide emulsion layer, wherein the non-image forming layer includes a substantially light-insensitive silver halide fine grain emulsion having an average grain size not greater than 0.05 μm and an average iodide content of 0.50 to 3.00 mol %.

2. The silver halide color photographic material of claim 1, wherein said sensitizing dye has a solubility in water of $2\times10^{-4}$ to $4\times10^{-2}$ mol per liter of water at 27° C.

3. The silver halide color photographic material of claim 1, wherein said solid particles of said sensitizing dye have an average size of 1 μm or less in diameter.

4. The silver halide color photographic material of claim 1, wherein said aqueous medium is substantially free from an organic solvent and a surfactant.

5. The silver halide color photographic material of claim 1, wherein said light-insensitive silver halide fine grain emulsion is monodispersed.

6. The silver halide color photographic material of claim 1, wherein said light insensitive silver halide grain emulsion comprises silver iodobromide, silver chloroiodobromide or silver iodochloride.

7. The silver halide photographic material of claim 1 wherein the light-insensitive fine grain emulsion is prepared by a process comprising (a) forming a silver halide grain emulsion by adding a water-soluble silver salt and a water-soluble halide to a mother liquor;

(b) desalting the emulsion in the presence of a modified gelatin at a pH not greater than 5.5; and (c) dispersing the desalted emulsion in an aqueous solution, wherein the solution includes gelatin having a calcium content not greater than 1000 ppm on average.

* * * * *